US008584302B2

(12) United States Patent
Stroup

(10) Patent No.: US 8,584,302 B2
(45) Date of Patent: Nov. 19, 2013

(54) SELF-CLEANING RETRACTABLE PUTTY KNIFE

(76) Inventor: Scott Stroup, Lake Havasu, AZ (US)

( * ) Notice: Subject to any disclaimer, the term of this patent is extended or adjusted under 35 U.S.C. 154(b) by 896 days.

(21) Appl. No.: 12/577,190

(22) Filed: Oct. 11, 2009

(65) Prior Publication Data

US 2011/0083294 A1 Apr. 14, 2011

(51) Int. Cl.
*B05C 17/10* (2006.01)

(52) U.S. Cl.
USPC ..... 15/236.01; 15/235.8; 15/245.1

(58) Field of Classification Search
USPC ..... 15/236.01, 235.8, 245.1
See application file for complete search history.

(56) References Cited

U.S. PATENT DOCUMENTS

| | | | | |
|---|---|---|---|---|
| 2,271,285 | A | 1/1942 | Bussed | |
| 3,451,486 | A * | 6/1969 | Vostoris | 172/13 |
| 3,744,079 | A | 7/1973 | Krause | |
| 3,956,858 | A | 5/1976 | Catlin et al. | |
| 4,097,951 | A | 7/1978 | Hurtt | |
| D268,085 | S | 3/1983 | Brunson et al. | |
| 4,414,966 | A | 11/1983 | Stednitz | |
| D279,933 | S | 7/1985 | Gaines | |
| 4,536,910 | A | 8/1985 | Clark | |
| 4,794,694 | A | 1/1989 | Daniel et al. | |
| 4,894,979 | A | 1/1990 | Lohrentz | |
| 4,919,604 | A | 4/1990 | Wilson | |
| 5,018,956 | A | 5/1991 | Lemaster | |
| 5,029,504 | A | 7/1991 | Wilbur et al. | |
| 5,251,352 | A | 10/1993 | Cullison | |
| 5,850,663 | A | 12/1998 | Hardy et al. | |
| 5,956,799 | A | 9/1999 | Panaccione et al. | |
| 6,311,463 | B1 | 11/2001 | Mellin et al. | |
| 6,351,887 | B1 | 3/2002 | Hurst | |
| 6,775,912 | B2 * | 8/2004 | Panfili et al. | 30/169 |
| 6,776,595 | B2 | 8/2004 | Dewberry | |
| 7,386,914 | B2 | 6/2008 | Cruzan | |
| 2002/0073554 | A1 | 6/2002 | Chen | |
| 2006/0230568 | A1 | 10/2006 | Cruzan | |
| 2007/0256306 | A1 | 11/2007 | Gringer et al. | |

FOREIGN PATENT DOCUMENTS

| | | | |
|---|---|---|---|
| CN | 21116399 | Y | 9/2007 |
| GB | 333815 | | 8/1930 |
| GB | 2199878 | A | 7/1988 |
| SU | 1671824 | A1 | 8/1991 |
| WO | 2008094997 | A3 | 8/2008 |
| WO | 2008095045 | A2 | 8/2008 |

OTHER PUBLICATIONS http://cgi.ebay.com/PUTTY-BUDDY-BRAND-NEW-IN-PACK-AGE-4-TOOLS-IN-ONE-~~- CAULK_W0QQitemZ330332726746QQcmdZViewItemQQimsx-Z20090524?IMSfp=TL090524146008r16073 Downloaded May 24, 2009.

* cited by examiner

*Primary Examiner* — Randall Chin
(74) *Attorney, Agent, or Firm* — Russ Weinzimmer & Associates P.C.

(57) ABSTRACT

A self-cleaning retractable putty knife is disclosed that wipes moist putty residues off its blade by retracting the blade into the handle of the knife. The handle includes a retraction aperture which wipingly contacts the majority of the blade surface during retraction of the blade. The retraction aperture is formed of a flexible material able remain in continuous wiping contact with the blade, even if the blade has a tapered dimension. Alternatively, the aperture can include spring-loaded movable gates that maintain continuous wiping contact with the blade. In some embodiments, the blade can be selectably locked at various positions to provide various extension lengths. The blade can be retracted either manually or mechanically.

14 Claims, 6 Drawing Sheets

SELF-CLEANING RETRACTABLE PUTTY KNIFE

TECHNICAL FIELD

This application relates generally to putty application devices and more specifically to putty knives.

BACKGROUND

A putty knife benefits from having a smooth blade surface when applying and smoothing semisolid materials, such as putty or mortar. A smooth blade surface improves the resultant surface quality of the applied semisolid material. Materials such as putty or epoxy may dry and adhere to the surface of the putty knife, which may result in degraded performance during its next use, due to the rough surface of the dried putty adhering to the blade surface of the putty knife, thereby preventing uniform application of the putty.

Adhered putty materials may require time-consuming manual or mechanical cleaning so as to return the putty knife to its original smooth condition. Furthermore, manual or mechanical cleaning methods for removing dried and solid adhered materials may cause damage to the surface of the putty knife due to wiping, sanding, abrading or scraping of the dried and solid adhered materials from the blade surface, thereby degrading the quality of the blade, impairing its performance, and reducing its useful life.

It is known to make putty knifes with smooth surfaces and non stick surfaces, but obtaining a clean putty knife still requires manual cleaning of the blade after use.

DETAILED DESCRIPTION

A retractable self-cleaning putty knife is taught which is capable of cleaning its own blade by retracting the blade into a channel which wipes putty from the blade before the putty dries on the blade. In particular, this self-cleaning feature works because putty is still in a moist, non-solid, and non-adherent state at the time the blade use is completed, and thus can be more easily wiped off without damaging the blade. The term "putty" is to be interpreted broadly, including such items as window glazing compound, plaster, caulk, grout, cement, mortar, wood filler, joint compound, non-cured polymer, plastic, filled plastic and unhardened epoxy. Putty knife uses can include spreading, distributing, smoothing, shaping, molding, sculpting, applying, filling, stripping, and scraping.

It should be noted that the illustrative embodiments disclosed are not intended to be limiting, but rather may include alternative arrangements clear to one of ordinary skill in the art, in order to obtain the desired final arrangement and result.

Such non illustrated potential variations in the described embodiments should be considered to be within the scope of this disclosure.

Figure 1:
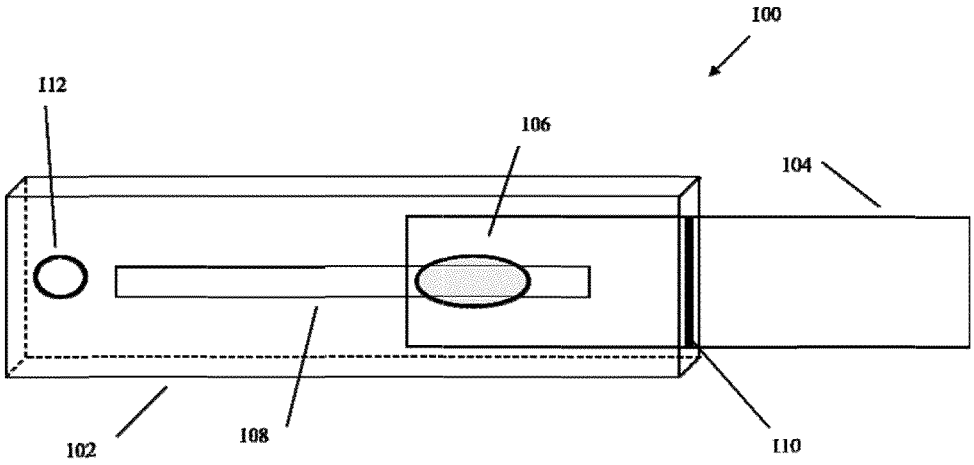
FIG. 1 is an isometric view of a retractable putty knife, according to various disclosed embodiments.

FIG. 1 shows a retractable putty knife 100, having a partially hollow body 102 with a channel to contain an extensible blade 104. The blade 104 may be a flexible blade formed of a metal material such as steel, and does not necessarily have a rectangular shape as illustrated in FIG. 1. The blade 104 is extended out of the body 102, or retracted back into the body 102, via an attached control surface 106, which may include a non-slip or textured surface located external to the body 102 for enhanced manual control by a user, preferably using his/her thumb.

The control surface 106 extends outside the body 102 through slot 108, and can be used to retract the blade 104 entirely within the body 102. The control surface 106 may include latching points (also called "detents") (shown in greater detail in FIG. 4) that can hold the blade at progressive degrees of extension, so as to provide a variety of different blade flexibility states and different uses. The retraction of the blade 104 by the control surface 106 causes the top and bottom surfaces of the blade to have excess putty material removed from the blade by contact with the aperture 110. The aperture 110 is sized to match the dimension of the blade and may include pressure application mechanism to keep a steady selected pressure on the blade. Such pressure application mechanism can include the use of an elastomeric material having sufficient compliance to maintain pressure on the blade. Alternatively, the aperture may have movable jaws held closed by spring tension. Furthermore, the body 102 of the putty knife can include a hole 112 extending completely through the body for attachment of a cord or for hanging storage on a peg board.

Figure 2:
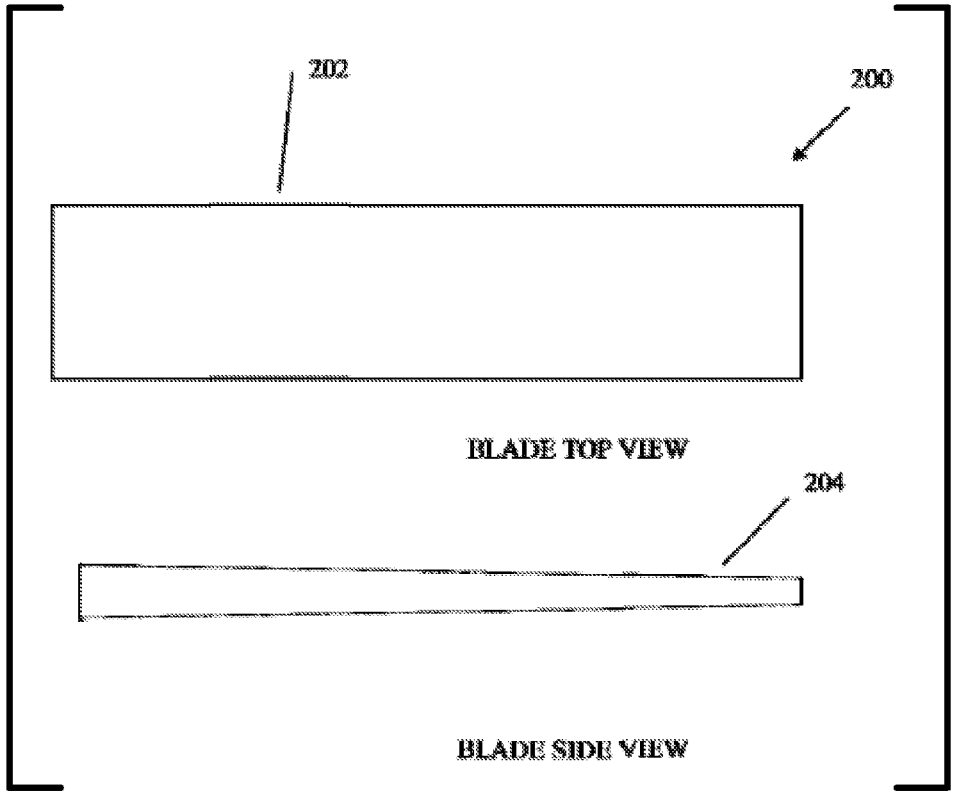
FIG. 2 shows a top view and a side view of a putty knife blade of the retractable putty knife of FIG. 1.

FIG. 2 includes a top view, and a side view, of a putty knife blade oriented in a horizontal position. As noted previously, the blade need not be rectangular and may change shape and dimension as appropriate for various uses. In one preferred embodiment the blade 200 can be rectangularly shaped 202 as seen from the top view, tapering down to a thinner thickness near the tip as shown in the bottom image of a blade side view 204. Such a thinner blade can be more flexible and can be useful for smoothing operations and feathering. The blade could become narrower at the tip, than near the handle. Alternatively, the blade could flare outwardly to become wider at the tip than near the handle, such as in the case of a plastering blade, and as shown in more detail in FIG. 6 and associated discussion.

Figure 3:
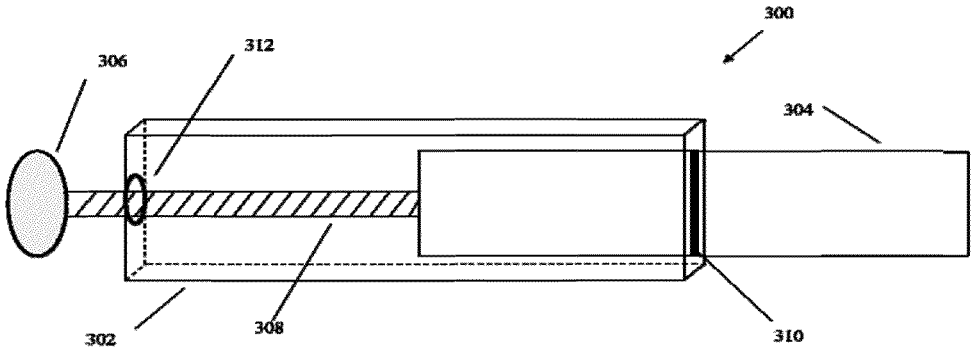
FIG. 3 is an isometric view of an alternative embodiment of the invention including a plunger for extending and retracting the blade.

FIG. 3 shows a plunger arrangement for extending the blade, as compared to the manual thumb control surface previously illustrated. In FIG. 3 the putty knife 300 includes a body 302 with a retractable blade 304, where the blade can be extended or retracted through aperture 310 into the body by an actuator 306 operating threaded rod or screw 308 attached between the actuator 306 and the blade 304. Through this operation, the embodiment of FIG. 3 can act as a plunger. The screw 308 can move the blade 304 by a threaded connection with a threaded aperture 312 in the body 302 of the putty knife. The actuator 306 can include a thumb screw, a wing nut, or an electrical motor for power retraction. Alternatively, the threaded aperture 312 may include a solenoid through which the rod 308 moves.

Figure 4:
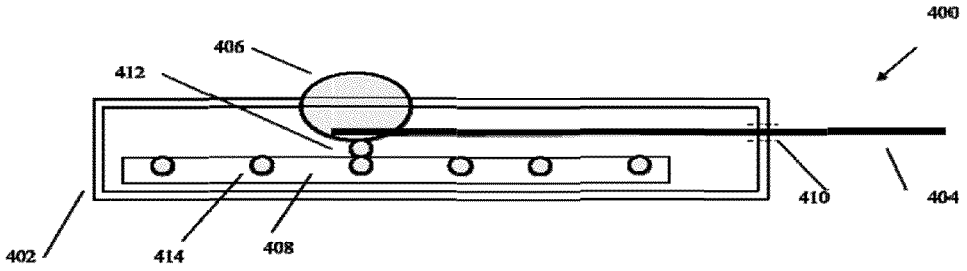
FIG. 4 is a side view of a preferred embodiment including a plurality of detents.

FIG. 4 shows a side view of an alternative manual extension and locking arrangement including a plurality of latching points or "detents." In this embodiment the blade is not tapered. The putty knife 400 includes a hollow body 402 and a thin blade 404 controlled by a manual control surface 406 that extends through a slot (not shown) in the body 402 to the external portion of the putty knife. The manual control surface 406 engages removably with an extension locating device 408 as the blade 404 is extended and retracted through the blade aperture 410 (shown as dotted lines). The blade aperture 410 is enabled to maintain substantial contact with the entirety of at least the top and bottom surfaces of the blade 404, and to remove remaining putty from the blade during retraction into the body 402, thereby cleaning the blade.

The blade 404 can be maintained at a selected extension from the body 402 by the engagement of the control surface 406 having a projecting portion 412 with a selected number of detents 414 in the extension locator 408. Alternative arrangements for controlling and maintaining a selected extension length of blade 404 may include a spring loaded control surface 406 engaged in lateral extensions of the operating slot (not shown in FIG. 4 but seen as element 108 in FIG. 1) and released for extension or retraction by pressing the control surface 406 down against the action of a spring, thus removing the engagement of the control surface from the lateral extensions. Other locking methods will occur to those of ordinary skill in the art and should be included in the scope of this disclosure.

Figure 5:
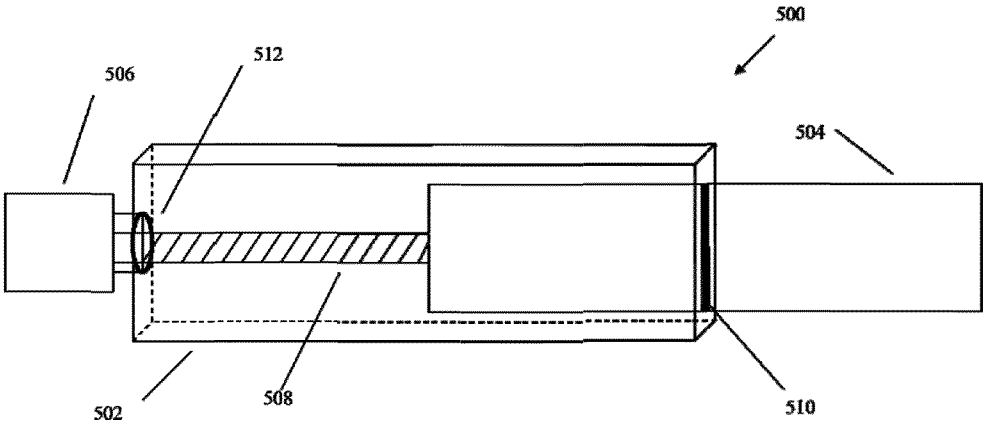
FIG. 5 illustrates a retractable putty knife including a motorized retraction mechanism.

FIG. 5 shows a putty knife including a motorized retraction mechanism, as compared to the manual extension and retraction arrangement of FIG. 3. In the figure a putty knife 500 includes a body 502 with a retractable blade 504, where the blade can be extended or retracted into the body by an electrical motor 506 rotating a threaded rod 508 attached to the blade 504. A threaded aperture 512 can be included to allow support for rotational movement of the threaded rod. The blade 504 can be wiped clean by contact with aperture 510 during retraction. Other motorized embodiments will occur to those of ordinary skill in the art and should be included in the scope of this disclosure.

Figure 6:
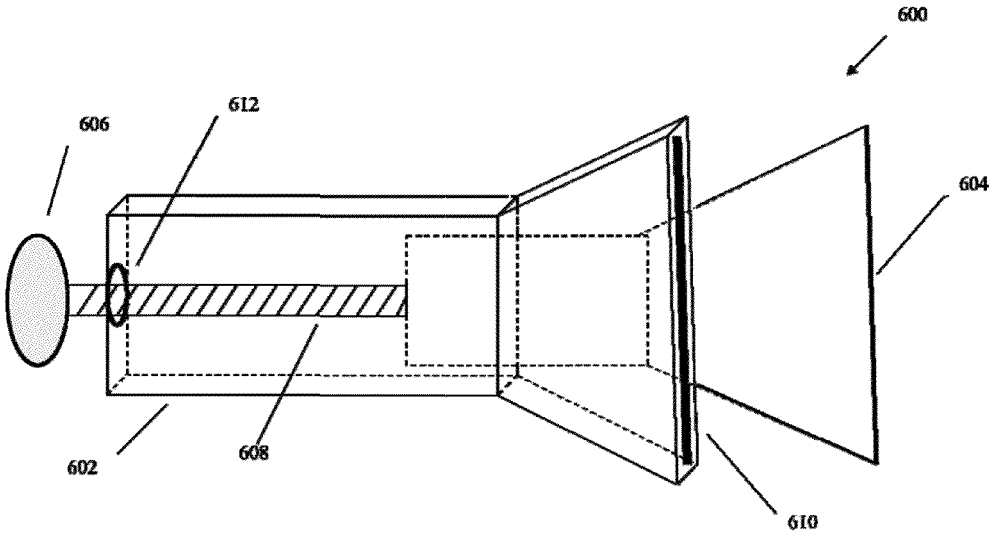
FIG. 6 illustrates a retractable putty knife having a flared blade profile.

FIG. 6 shows a putty knife having a flared blade profile, wherein the blade is wider at blade locations distal from the handle. Such blades may be useful for spreading and smoothing large areas of plaster. The self-cleaning retractable putty knife 600 includes a handle 602 which flares out at one end to contain the wider portion of the blade 604 when in a retracted position. The blade 604 can be extended and retracted as discussed in the prior figures and discussion. In this figure, the blade is shown with a thumb-screw-type manual controller 606, operating as previously discussed with a threaded rod 608 attached to the blade 604 and passing through the threaded aperture 612. The blade is retracted and wiped clean by contact with a compliant and sized aperture 610, which is selected to be sufficiently long to contact substantially all portions of at least the top and bottom surfaces of blade 604.

CONCLUSION

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and structural, locking, and mechanical and electrical changes may be made without departing from the scope of the disclosed embodiments. The various embodiments are not necessarily mutually exclusive, as some embodiments can be combined with one or more other embodiments to form new embodiments.

The term "putty" as used in the description may include any viscous semi-liquid material similar to putty including, but not limited to grout, cement, caulk, plaster, liquid polymer and plastic. The term "knife" as used in the description may include any structure having a thin flat structure, including but not limited to a knife, blade, palette, and scrapper. The term "compliant" is understood to include any resilient material that may be compressed and returned to an initial position including but not limited to: rubber, silicone and foam, as well as spring loaded structures such as coiled springs, leaf springs and elastic bands. The term "applying" also refers to removal operations including scraping, stripping, and flaking, in addition to spreading, smoothing and filling.

The term "horizontal" as used in this application is defined as a plane parallel to the conventional plane or surface of a blade or other thin flat object, regardless of the orientation of the blade with respect to the earth. The term "vertical" refers to a direction perpendicular to the horizontal as defined above. Prepositions, such as "on", "side" (as in "sidewall"), "higher", "lower", "over", "top", "bottom" and "under" are defined with respect to the conventional plane or surface of the top surface of the blade, regardless of the orientation. The detailed description is, therefore, not to be taken in a limiting sense, and the scope of the present invention is defined only by the appended claims, along with the full scope of equivalents to which such claims are entitled.

An illustrative embodiment of a retractable putty knife can include a blade for applying putty to a surface, with a handle attached to the blade. The handle can include a channel into which the blade can be retracted, perhaps entirely within the handle, thereby passing the blade past a contacting surface and cleaning putty off of the blade. The putty knife can include a retracting mechanism connected to both the blade and the handle, the retracting mechanism capable of moving the blade into the channel of the handle, and thus cleaning putty off of the blade.

In an alternative embodiment the blade may be a parallelepiped (i.e., a six sided solid object class that includes cubes, etc.) and include a top and a bottom surface, a left side surface and a right side surface, and a front surface and a back surface with reference to a horizontally held blade. In the case of a putty knife the top and bottom surfaces are relatively close to one another since the blade may be quite thin in order to be flexible. The left and right side surfaces can be small since the sides of a knife edge can be thin. Such blades do not have to be rectangular and may taper in any dimension.

In an illustrative embodiment the blade includes at least two surfaces oriented parallel to one another, as can typically be the case with putty knives that have a uniform thickness and width. In another embodiment the two surfaces oriented parallel to one another can include the top and the bottom surface (i.e., the thickness of the blade is uniform), and the left side and right side surfaces may not be parallel. This arrangement can be found in knife edges used to apply putty or plaster into narrow spaces such as corners, or for scrappers. For example, the left side and right side surfaces may not be parallel, and a first part of the blade close to the handle may taper down, so the left and right side surfaces are closer together than the blade further from the handle. Such an arrangement may be useful in applying and feathering joint compound. In either case the retracting mechanism can be manually operable, and include a plurality of locking locations to hold the blade at various different extension distances from the handle end. Alternatively, the retracting mechanism may be a threaded screw extending from a rear portion of the blade through a threaded portion of the handle, and thus hold the blade at an essentially infinite number of extension lengths. The threaded screw may also be extended or retracted by a battery operated electrical motor, or the threaded screw may be replaced by a rod (threaded or not) and operated by a solenoid.

In either case, the channel in the handle can include one or more compliant openings or apertures that press against the top and bottom surfaces of the blade with enough force to wipe the blade clean when retracted. The opening or aperture can also be designed to press against the sides and even to close together when the extended end of the blade is retracted inside the handle, thus cleaning the blade tip. The compliant opening can be formed in various ways, including use of an elastomeric material such as rubber, or spring loaded movable gates, and can include an abrasive material, a scraping material, or a magnetic material.

The retracting mechanism can be mechanically operable via an electrical motor using a screw connecting between the electrical motor and the blade, or by use of a solenoid connected between the handle and the blade, and using either a screw or a rod. The retracting mechanism can be manually operated using pressure indents, spring loaded capture slots, or by screw drive using a thumb screw handle, a wing nut handle, or other similar gripping devices.

An embodiment of a method of cleaning a blade, can include driving the blade past one or more pairs of compliant surfaces, so as to wipe the blade during retraction into the handle. The wiping surfaces can be located immediately adjacent and parallel to each other, at or near an opening into the handle, and they can be separated by a selected distance and are held there by sufficient force to wipe the blades. The selected distance should be less than the lowest thickness of the blade to maintain contact over the entire blade surface. The compliant surfaces can be formed of an elastomeric material, or be spring loaded movable gates, and include abrasives, or have a scraper, or be held to the blade by a magnetic material. The blade drive can be a threaded screw that is either manually driven, or mechanically and/or electrically driven, by a motor or solenoid for example.

An embodiment can include a self-cleaning blade having a handle attached to the blade, and a retracting mechanism connected to both the blade and the handle capable of retracting the blade entirely into a channel in the handle. An embodiment can include an aperture at the open end of the channel, sized to remain in contact with substantially all of the top and bottom surfaces of the blade. The aperture can be formed of a compliant material so as to remain in contact with both the top and bottom surfaces of the blade as the blade potentially tapers, and keep a sufficient pressure on the blade to wipe the blade clean. The aperture material can be an elastomeric material, or a spring loaded mechanism, and can include an abrasive material and/or a magnetic material.

Although specific embodiments have been illustrated and described herein, it will be appreciated by those of ordinary skill in the art that any arrangement that is calculated to achieve the same purpose can be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed is:

1. A retractable self-cleaning putty knife, comprising:

a blade for applying putty to a surface;

a handle attached to the blade, wherein the handle includes a channel into which the blade can be retracted, thereby cleaning putty off of the blade;

a compliant aperture of the channel, the compliant aperture being capable of pressing against at least two surfaces of the blade with a selected force; and a retracting mechanism cooperative with the blade and the handle, the retracting mechanism capable of retracting the bade into the channel of the handle, thereby cleaning putty of the blade.

2. The putty knife of claim 1, wherein the blade comprises a top and a bottom surface, a left side and a right side surface, and a front and a back surface.

3. The putty knife of claim 2, wherein the blade includes at least two surfaces oriented parallel to each another.

4. The putty knife of claim 1, wherein the left side and right side surfaces are not parallel, and wherein a first portion of the blade closer to the handle tapers so the left and right side surfaces are closer together than a second portion of the blade further from the handle.

5. The putty knife of claim 1, wherein the retracting mechanism is manually operable.

6. The putty knife of claim 5, wherein the retracting mechanism further includes at least four locations for locking the blade at four different extensions from the handle.

7. The putty knife of claim 5, wherein the retracting mechanism comprises a threaded screw extending from a rear portion of the blade through a threaded portion of the handle.

8. The putty knife of claim 1, wherein the compliant aperture includes at least one of an elastomeric material, spring loaded movable gates, an abrasive material, a scraping material, and a magnetic material.

9. The putty knife of claim 1, wherein the retracting mechanism is mechanically operable.

10. The putty knife of claim 9, wherein the retracting mechanism is operable via an electrical motor.

11. The putty knife of claim 10, wherein the retracting mechanism comprises a screw driven connection between the electrical motor and the blade.

12. The putty knife of claim 11, wherein the retracting mechanism comprises a solenoid connected between the handle and the blade.

13. A retractable self-cleaning putty knife, comprising:

a handle attached to a blade;

a retracting mechanism connected to both the blade and the handle, the retracting mechanism being capable of retracting the blade entirely into a channel disposed inside the handle; and an aperture disposed at an end of the channel having a dimension selected to remain in contact with substantially an entirety of both a top and a bottom surface of the blade, wherein the aperture includes a compliant material enabled to remain in a selected range of contact pressure with both top and bottom surface of the blade as a selected dimension of the blade tapers from a first portion of the blade to a second portion of the blade.

14. The retractable self-cleaning putty knife of claim 13, wherein the aperture is formed of at least one of an elastomeric material, a spring loaded mechanism, an abrasive material, and a magnetic material.

* * * * *